US006823704B2

(12) United States Patent
Nakamura et al.

(10) Patent No.: US 6,823,704 B2
(45) Date of Patent: Nov. 30, 2004

(54) APPARATUS AND METHOD OF FORMING CYLINDRICAL WORK PIECE

(75) Inventors: Yoshinobu Nakamura, Amagasaki (JP); Hiroaki Mizumoto, Amagasaki (JP)

(73) Assignee: Nihon Spindle Mfg. Co., Ltd., Hyogo (JP)

( * ) Notice: Subject to any disclaimer, the term of this patent is extended or adjusted under 35 U.S.C. 154(b) by 0 days.

(21) Appl. No.: 10/197,429

(22) Filed: Jul. 18, 2002

(65) Prior Publication Data

US 2004/0011105 A1 Jan. 22, 2004

(51) Int. Cl.[7] ..... B21D 3/02
(52) U.S. Cl. ..... 72/121; 72/84; 72/125
(58) Field of Search ..... 72/82, 83, 84, 72/85, 94, 101, 120, 121, 125, 370.24, 370.25, 441, 447

(56) References Cited

U.S. PATENT DOCUMENTS 6,018,972 A * 2/2000 Irie ..... 72/121
6,216,512 B1 * 4/2001 Irie ..... 72/121
6,233,993 B1 * 5/2001 Irie ..... 72/121
6,467,322 B2 * 10/2002 Nogami et al. ..... 72/121
2003/0172702 A1 * 9/2003 Massee ..... 72/121

FOREIGN PATENT DOCUMENTS

WO 02/16058 * 2/2002 ..... B21D/22/14

* cited by examiner

*Primary Examiner*—Ed Tolan
(74) *Attorney, Agent, or Firm*—Wenderoth, Lind & Ponack, L.L.P.

(57) ABSTRACT

A forming apparatus forming part of or the entire circumference of a cylindrical work piece into a circular or deformed circular shape, such as an ellipse, etc. A spindle mechanism has a processing tool R mounted at the tip of the spindle, and a holding mechanism holds the cylindrical work piece W disposed in a way to face the spindle mechanism. An axial shifting means for shifts the spindle mechanism and the holding mechanism relatively in the axial direction of the spindle. A shifting motion means enabling the holding mechanism to make prescribed shifting motion, and a control mechanism drives the axial shifting means and shifting motion means in linkage with each other.

12 Claims, 16 Drawing Sheets

APPARATUS AND METHOD OF FORMING CYLINDRICAL WORK PIECE

BACKGROUND OF THE INVENTION

The present invention concerns a forming method for forming part of or the entire circumference of a cylindrical work piece into circular or deformed circular shape, such as ellipse, etc., for example, by executing forming on a cylindrical work piece, and an apparatus for such forming.

Forming work on cylindrical work piece includes drawing, cutting, etc., for example.

Usually, when executing such forming work, or in the case where a cylindrical work piece is formed into circular shape by means of a processing tool mounted on a spindle, for example, the processing is preformed by fixing the work piece and turning the spindle together with the processing tool, while moving the processing tool mounted on a spindle in the radial direction of the spindle.

In that case, however, the mechanism for moving the processing tool mounted on a spindle in the radial direction of the spindle becomes extremely complicated in structure, presenting problems of high manufacturing cost and difficulty of maintenance.

Moreover, from a structural reason of said mechanism, it is very difficult to form, by drawing, in a deformed circular shape such as an ellipse, etc. Because of this difficulty, processing of the muffler of an automobile, etc. used to be made by a method which consists in forming pieces in half size by punching, etc., putting them together and forming them into an integrated body by welding, etc. But this method also had problems of troublesome manufacturing processes, and high manufacturing cost due to complication of manufacturing processes such as manufacture of forming dies to be used for punching and setup process, etc.

SUMMARY OF THE INVENTION

The objective of the present invention is to provide a forming method for forming part of or the entire circumference of a cylindrical work piece into a circular or deformed circular shape, such as an ellipse, etc., for example, by executing forming work on a cylindrical work piece, and an apparatus for such method that is capable of solving said problems of conventional forming method for cylindrical work piece.

The forming method for a cylindrical work piece according to this first invention, for achieving said objective, is a forming method for executing forming work on a cylindrical work piece, by means of a forming apparatus comprising a spindle mechanism provided with a processing tool mounted at the tip of the spindle, and a holding mechanism for holding a cylindrical work piece disposed in such a way that it faces the spindle mechanism, characterized in that prescribed forming work is executed on the work piece, by putting the holding mechanism in a prescribed shifting motion, while shifting the spindle mechanism and the holding mechanism relatively in the axial direction of the spindle, and by relatively shifting said processing tool along the outer circumference of the work piece.

This forming method for a cylindrical work piece, realized in such a way that prescribed forming work is executed on the work piece by putting the holding mechanism in a prescribed shifting motion while shifting the spindle mechanism and the holding mechanism relatively in the axial direction of the spindle, and by relatively shifting the processing tool along the outer circumference of the work piece, can secure a high degree of freedom for the relative shifting of the processing tool against the work piece, and can execute forming work on a cylindrical work piece into circular or deformed circular shapes, such as an ellipse, etc. for example, easily and with high accuracy.

Moreover, in addition to the above, it can also simplify the structure on the spindle side, which is liable to be a complicated structure, reduce the manufacturing cost of the apparatus, and facilitating maintenance thereof.

In this case, the shifting motion of the holding mechanism may be a circular motion.

This makes it possible to keep the worked section of the work piece in a circular shape.

Furthermore, the shifting motion of the holding mechanism may be a deformed circular motion such as ellipse, etc.

This makes it possible to keep the worked section of the work piece in a deformed circular shape such as ellipse, etc.

Still more, the center of the shifting motion of the holding mechanism may be deviated from the center axis of the spindle.

This makes it possible to execute processing work by keeping the center axis of the processed part of the work piece deviated from the center axis before processing of the work piece.

Yet more, the center of shifting motion of the holding mechanism may be deviated at a prescribed inclination against the center axis of the spindle.

This makes it possible to execute processing work by keeping the center axis of the processed part of the work piece inclined against the center axis before the processing of the work piece.

Moreover, the forming method may be realized in such a way as to make the inclination changeable during forming.

This makes it possible to execute processing work in a curved shape in which the center axis of the processed part of the work piece is inclined against the center axis before the processing of the work piece.

Furthermore, a drawing tool or a cutting tool may be used selectively as processing tools, to enable the selective execution of drawing or cutting on the work piece.

This makes it possible to selectively execute drawing and cutting on the work piece, simplify the manufacturing processes and improve production efficiency.

Moreover, the forming apparatus for a cylindrical work piece according to this second invention, which is an apparatus for implementing the forming method for a cylindrical work piece of this first invention, is a forming apparatus for cylindrical work pieces comprising a spindle mechanism provided with a processing tool mounted at the tip of the spindle, and a holding mechanism for holding the cylindrical work piece disposed in such a way as to face the spindle mechanism, it is provided with an axial shifting mechanism for relatively shifting the spindle mechanism and the holding mechanism in the axial direction of the spindle, a shifting motion mechanism for enabling the holding mechanism to make a prescribed shifting motion, and a control mechanism for driving the axial shifting and shifting motion mechanism in linkage with each other.

This forming apparatus for a cylindrical work piece, realized by comprising an axial shifting function for shifting the spindle mechanism and the holding mechanism relatively in the axial direction of the spindle, a shifting motion function for enabling the holding mechanism to make prescribed shifting motions, and a control mechanism for driving said axial shifting and shifting motion functions in linkage with each other, can simplify the structure on the spindle side, which is liable to be a complicated structure, reduce the manufacturing cost of the apparatus, and facilitate maintenance thereof.

Furthermore, in addition to the above, it can secure a high degree of freedom for the relative shifting of the processing tool against the work piece, and can execute forming work on a cylindrical work piece into circular or deformed circular shapes, such as an ellipse, etc. for example, easily and with high accuracy.

In this case, the shifting motion function may be comprised of two linear shifting means for shifting the holding mechanism in a prescribed direction and in the direction orthogonal to it, to enable the holding mechanism to make prescribed shifting motions by driving the two axial shifting mechanism in linkage with each other with the control mechanism.

This makes it possible to construct the shifting motion function with the two linear shifting functions and to simplify the structure of the shifting motion function, to further reduce the manufacturing cost of the apparatus and facilitate maintenance thereof.

Still more, a holding mechanism deviating function may be provided for deviating the axis of the holding mechanism at a prescribed inclination against the center axis of the spindle.

This makes it possible to execute processing work by keeping the center axis of the processed part of the work piece inclined against the center axis before processing of the work piece.

Yet more, a drawing tool or a cutting tool may be used selectively as processing tools.

This makes it possible to selectively execute drawing and cutting on the work piece, simplifying the manufacturing processes and improving production efficiency.

DETAILED DESCRIPTION OF THE INVENTION

Figure 1:
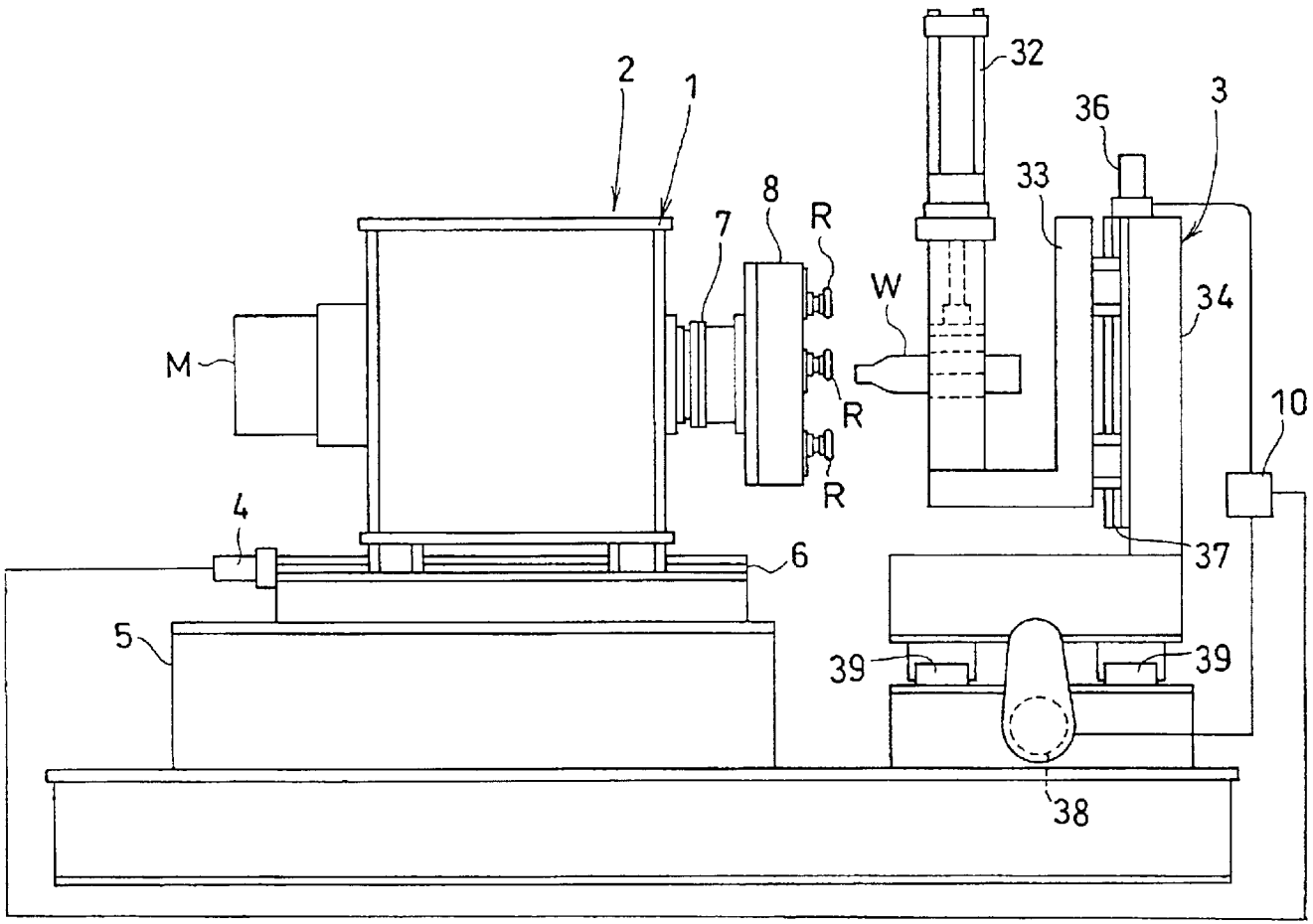
FIG. 1 is a side view of the forming apparatus for cylindrical work piece according to the present invention.
Figure 2:
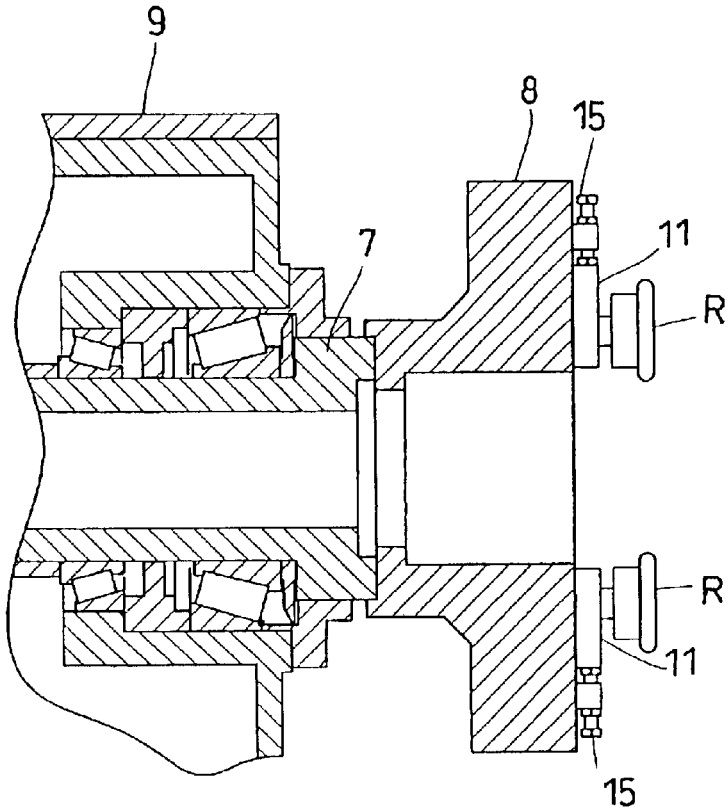
FIG. 2 is a longitudinal sectional view of the tip portion of the spindle mechanism.
Figure 3:
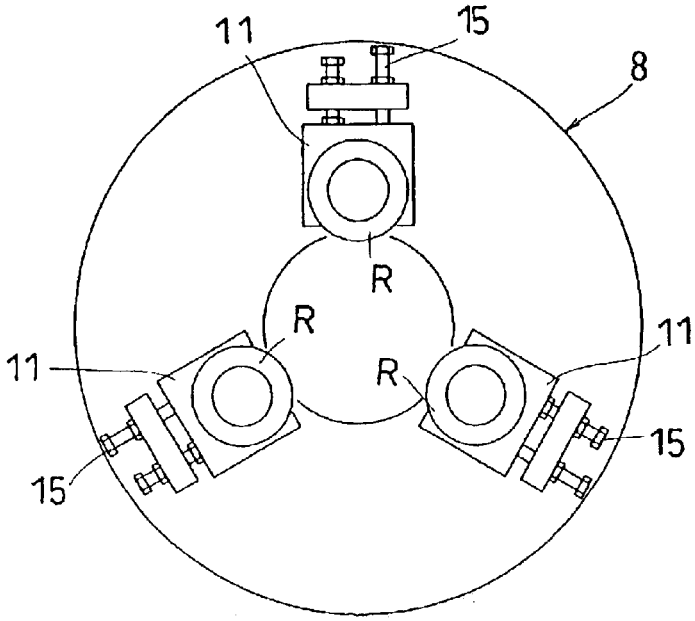
FIG. 3 is a front elevation of the mounting base of the drawing tool.
Figure 4:
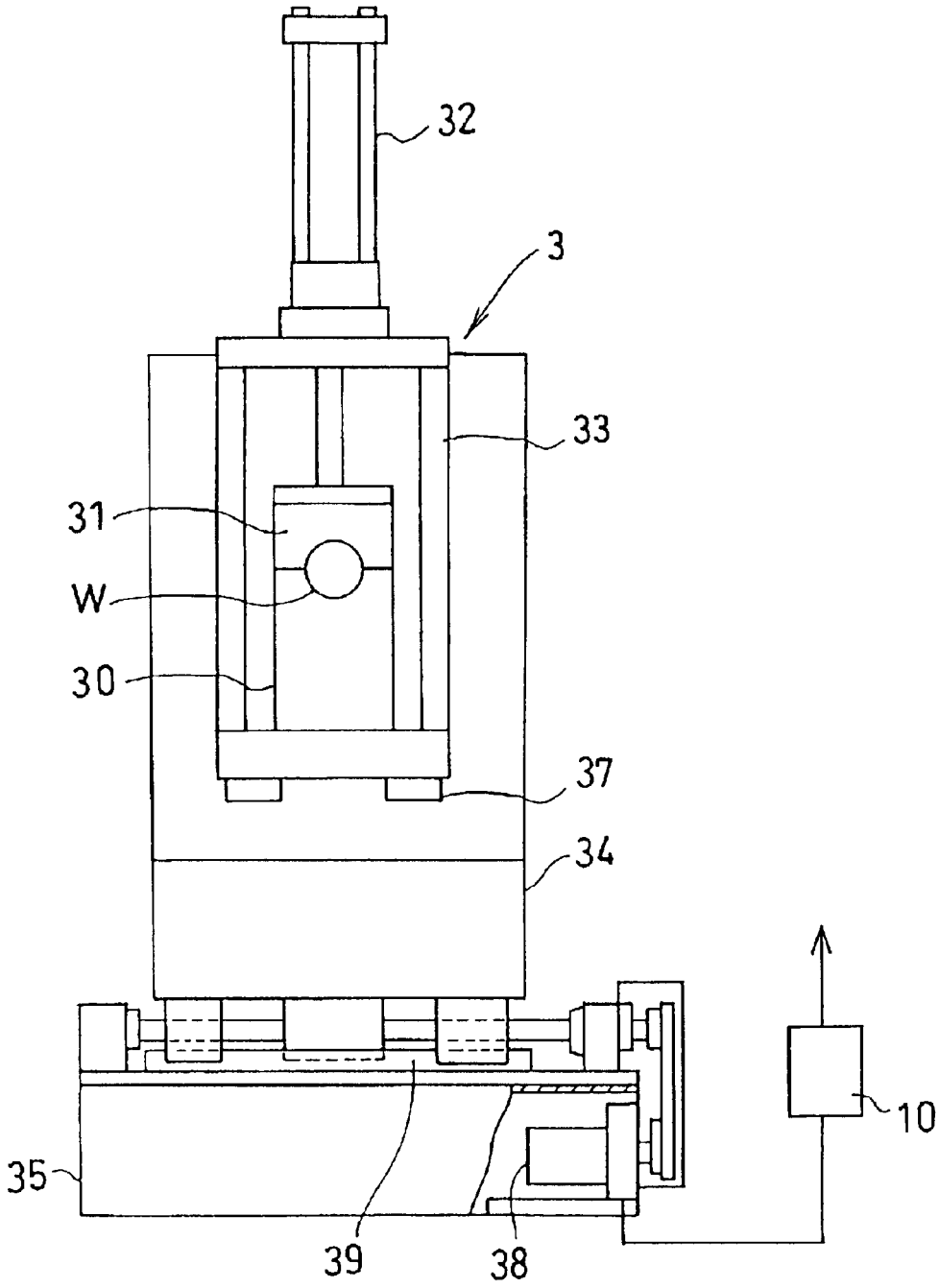
FIG. 4 is a front elevation of the holding mechanism.

Explanation will be given hereafter on embodiments of the forming method for cylindrical work piece and apparatus for such method according to the present invention, based on the drawings.

FIG. 1 to FIG. 4 show an embodiment of the forming apparatus for cylindrical work piece of the present invention.

This forming apparatus 1 comprises a spindle mechanism 2 provided with a processing tool R mounted at the tip of the spindle 7, and a holding mechanism 3 for holding cylindrical work piece W disposed in a way to face the spindle mechanism 2, and also comprises an axial shifting means 4 for shifting the spindle mechanism 2 and the holding mechanism 3 relatively in the axial direction of the spindle 7, shifting motion means 36, 38 for enabling the holding mechanism 3 to make prescribed shifting motion, and a control mechanism 10 for driving the axial shifting means 4 and shifting motion means 36, 38 in linkage with each other.

The spindle mechanism 2 is provided with a tool mounting stand 8at the tip of the spindle 7, placed in a way to be slidable in the longitudinal direction along a guide rail 6 installed on a base 5.

The spindle 7 is rotatably supported on a box 9 through bearing, and is driven to turn by a drive motor M.

The tool mounting stand 8 comprises a proper number of supporting member 11 (3 pieces in this embodiment) for mounting processing tool R at equal distance from the center. This supporting member 11 is provided with an adjusting means 15 for adjusting the distance of the processing tool(drawing tool in this embodiment) R from the center as required.

And, as axial shifting means 4 for shifting the spindle mechanism 2 and the holding mechanism 3 relatively in the axial direction of the spindle 7, a motor for longitudinal shifting 4 for shifting the spindle mechanism 2 in longitudinal direction along the guide rail 6 is provided in this embodiment.

The holding mechanism 3 for holding the cylindrical work piece W comprises a lower fixing claw 30 and an upper fixing claw 31 for pinching the cylindrical work piece W, a lifting frame 33 on which is mounted a cylinder 32 for lifting this lifting claw 31, a supporting frame 34 for supporting this lifting frame 33 in a way to allow lifting, and a fixed base 35 for supporting this supporting frame 34 in a way to allow shifting in transversal direction.

And, as shifting motion means 36, 38 for enabling the holding mechanism 3 to make prescribed shifting motion, a lifting motor 36 for lifting the lifting frame 33 along a guide 37 and a transverse shifting motor 38 for shifting the supporting frame 34 along a guide 39 are provided, to thereby enable the holding mechanism 3 to make prescribed two-dimensional shifting motion with linked driving of two linear shifting means as shifting motion means 36, 38.

Furthermore, this holding mechanism 3 may be provided with a holding mechanism deviating means (not illustrated) for deviating the axis of the holding mechanism 3 at prescribed inclination against the center axis of the spindle 7, by swinging the lifting frame 33 in horizontal plane. This holding mechanism deviating means may be constituted by disposing a turntable, capable of turning in the horizontal plane and adjusting an angle, on either the lifting frame 33, supporting frame 34 or fixed base 35, for example.

It is arranged so as to drive, with the control mechanism 10, the motor for longitudinal shifting 4 as axial shifting means for relatively shifting the spindle mechanism 2 and the holding mechanism 3 in the axial direction of the spindle 7 as well as the lifting motor 36 and the transversal shifting motor 38 as the shifting motion means for enabling the holding mechanism 3 to make prescribed shifting motion, in linkage with one another, to enable the holding mechanism 3 to make prescribed shifting motion.

Next, explanation will be given on an embodiment of a drawing method for cylindrical work piece W made by using this forming apparatus 1.

In the following description, both the shifting motion of the holding mechanism 3 and the shifting motion of the work piece W are expressed as shifting motion of work piece W, because they may be considered as identical in this context.

Figure 5:
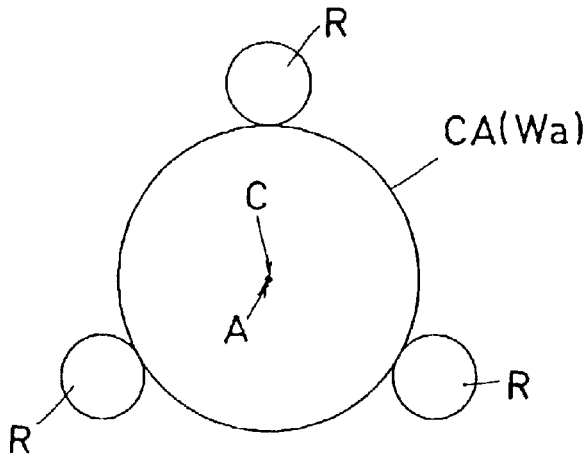
FIG. 5 is an explanatory drawing showing the reference position of the work piece in the case where the work piece is processed in a circular shape.

FIG. 5 indicates a state in the case of a reference position at which the center A of the work piece W, in the case where the work piece W is processed into circular shape, is made to agree with the center of rotation C of the drawing roller R.

In this case, the locus CA by the drawing roller R agrees with the outer circumference Wa of the drawn work piece W.

Figure 6:
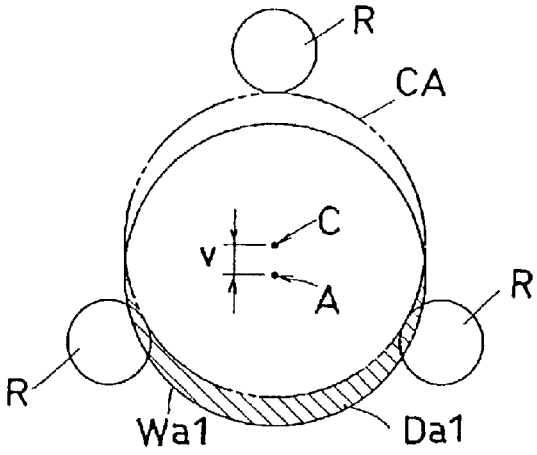
FIG. 6 is an explanatory drawing showing a state in the case where the work piece is shifted downward from the reference position.

Next, FIG. 6 indicates a state in the case where the center A of the work piece W is shifted downward by a distance v from the center of rotation C of the drawing roller R.

In this case, of the locus Wa1 of the work piece W, the portion Da1 off the locus CA by the roller is drawn, and the work piece W takes a circular shape deformed flat in up-down direction.

Figure 7:
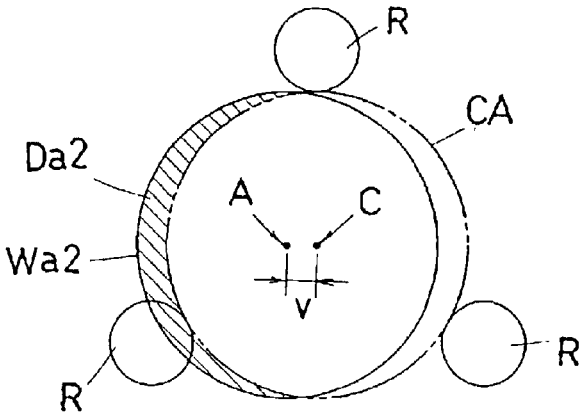
FIG. 7 is an explanatory drawing showing a state in the case where the work piece is shifted to the left from the reference position.
Figure 8:
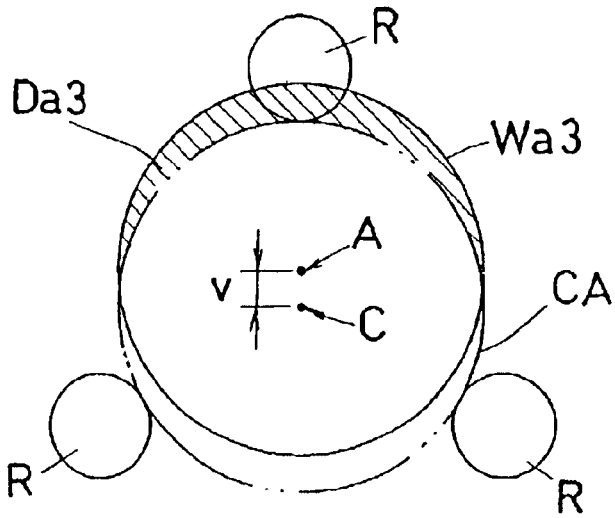
FIG. 8 is an explanatory drawing showing a state in the case where the work piece is shifted upward from the reference position.
Figure 9:
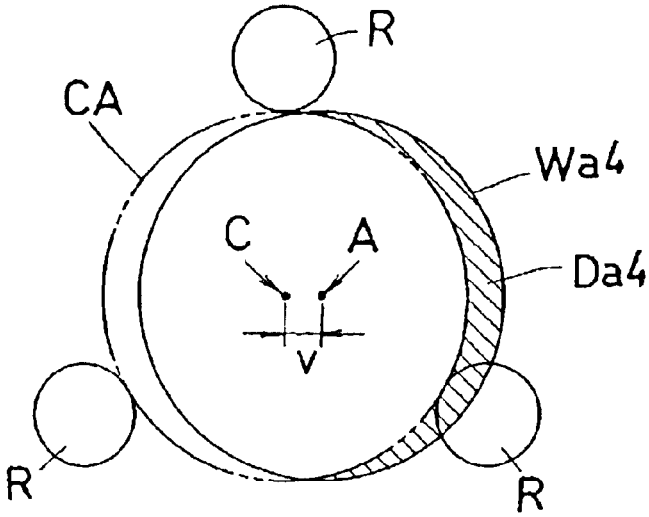
FIG. 9 is an explanatory drawing showing a state in the case where the work piece is shifted to the right from the reference position.

Next, FIG. 7 to FIG. 9 indicate a state in the case where the center A of the work piece W is shifted to the left, upward or to the right by a distance v from the center of rotation C of the drawing roller R.

Also in this case, in the same way as in FIG. 6, of the locus Wa2, Wa3, Wa4 of the work piece W, the portions Da2, Da3, Da4 off the locus CA by the roller are drawn, and the work piece W takes a circular shape deformed flat in either left-right or up-down direction.

Figure 10:
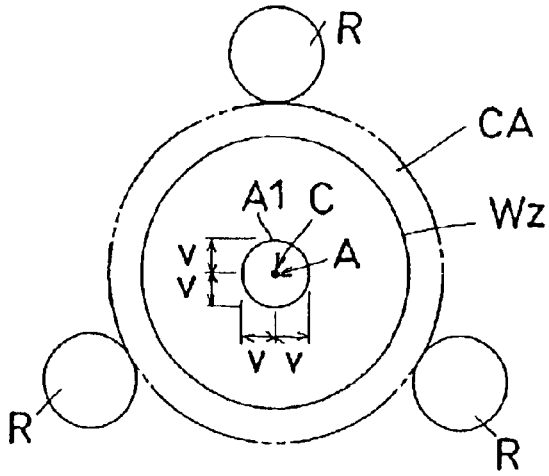
FIG. 10 is an explanatory drawing showing a state in the case where the work piece is shifted along the locus of a circular shape.

Next, FIG. 10, combination of the states of FIG. 5 to FIG. 9, indicates a case where the center A of the work piece W is shifted by a distance v around the center of rotation C of the drawing roller R, namely made to perform a circular motion A1 with a radius v around the center of rotation C of the drawing roller R.

FIG. 10 indicates a case where the center A of the work piece W is returned to the center of rotation C.

Figure 11:
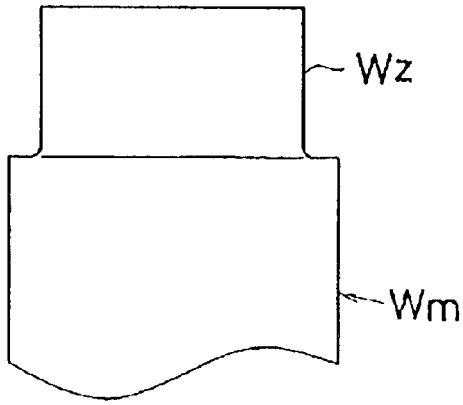
FIG. 11 is a front elevation of the formed piece in the case of FIG. 10.

In this case, the work piece W is drawn up to the outer circumference Wz and, as a result, the work piece W comes to be drawn into cylindrical shape as shown in FIG. 11.

Figure 27:
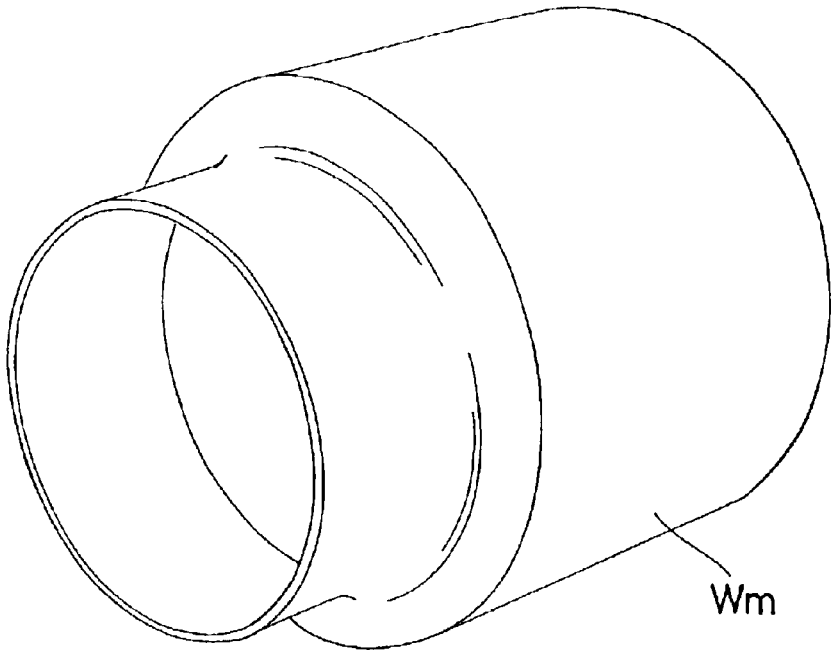
FIG. 27 is a perspective view of the formed piece in the case of FIG. 10.

FIG. 27 shows a perspective view of the formed piece Wm in this case.

Next, FIG. 12 indicates a case where the center m1 of the shifting locus L1 of the work piece W is made to agree with the center of rotation C of the drawing roller R, and the diameter of shifting motion of the work piece W is changed in proportion to the shifting by the motor for longitudinal shifting 4 (hereinafter referred to as "shifting in direction Z").

Figure 13:
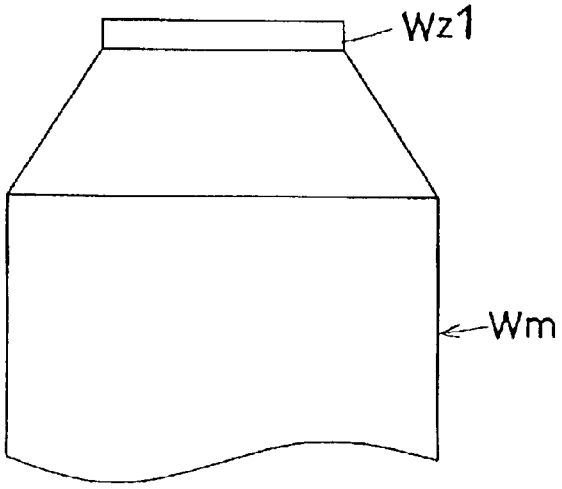
FIG. 13 is a front elevation of the formed piece in the case of FIG. 12.
Figure 14:
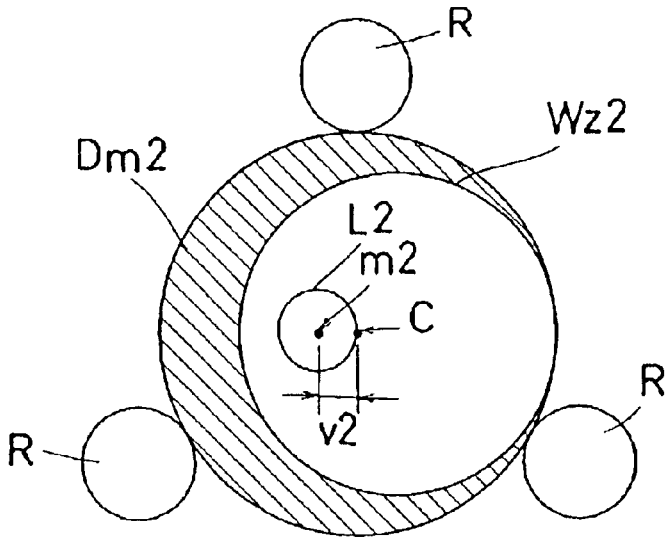
FIG. 14 is an explanatory drawing showing a state in the case where the center of the work piece is shifted along the locus of a circular shape deviated from the center axis of the spindle.
Figure 15:
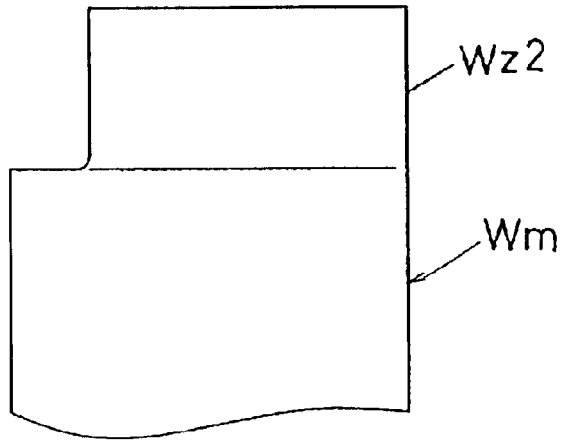
FIG. 15 is a front elevation of the formed piece in the case of FIG. 14.

In this case, the shaded portion Dm1 is drawn to the minimum diameter Wz1 and, as a result, the work piece W is drawn into circular truncated conical shape as shown in FIG. 13.

Figure 28:
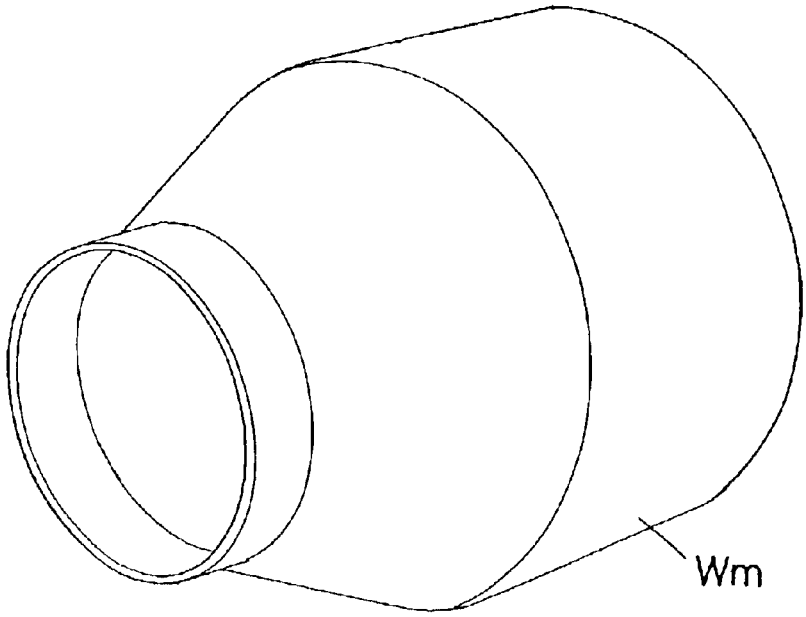
FIG. 28 is a perspective view of the formed piece in the case of FIG. 12.

FIG. 28 shows a perspective view of the formed piece Wm in this case.

The change of the diameter of shifting motion of the work piece W may be made, not only in a way to increase proportionally in a spiral shape, as shown in this embodiment, but also in such a way that the diameter of shifting motion of the work piece W increases by P*Q1 (Q1=constant of proportionality) when the shifting in direction Z takes place by a distance P, for example.

Next, FIG. 14 to FIG. 17 indicate a case where the center axis of shifting motion of the work piece W is deviated from the center axis of the spindle 7.

This is a case in which the center axis of shifting motion of the work piece W is shifted from the center of rotation C of the drawing roller R by v2, v3 respectively, moving the center of shifting motion to m2, m3 and the shifting locus to L2 (circular motion with a radius of v2), L3 (circular motion with a radius larger than v2), and the shaded portion Dm2, Dm3 are drawn to the minimum diameters Wz2, Wz3 into cylindrical shape.

Figure 16:
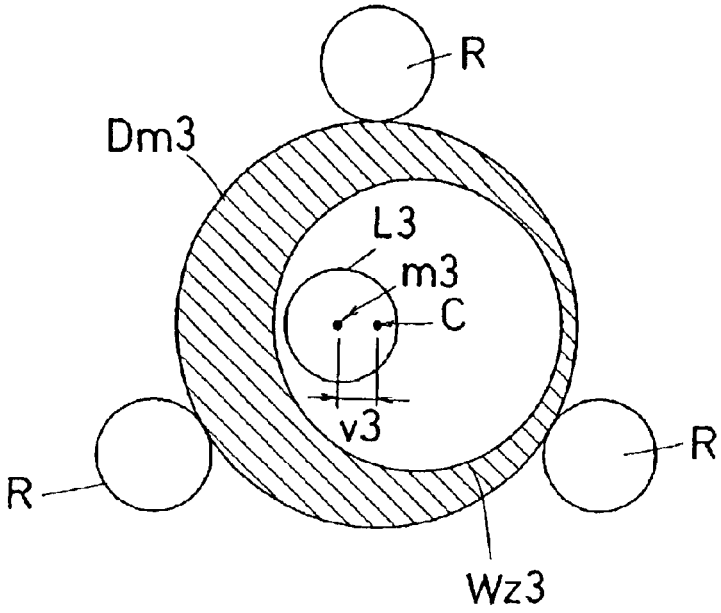
FIG. 16 is an explanatory drawing showing another state in the case where the center of the work piece is shifted along the locus of a circular shape deviated from the center axis of the spindle.
Figure 17:
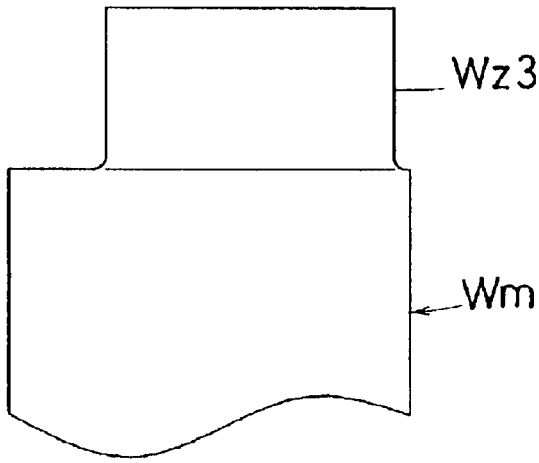
FIG. 17 is a front elevation of the formed piece in the case of FIG. 16.
Figure 29:
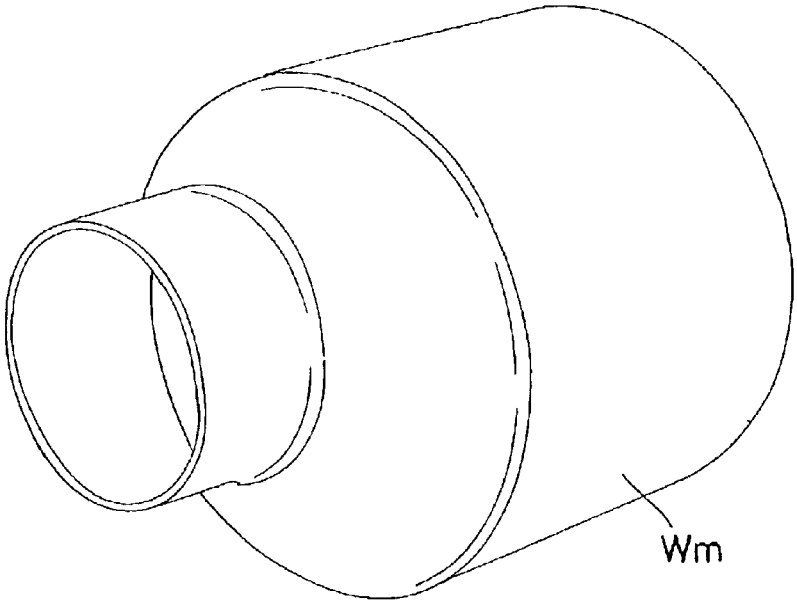
FIG. 29 is a perspective view of the formed piece in the case of FIG. 16.

FIG. 29 shows a perspective view of the formed piece Wm corresponding to FIG. 16 and FIG. 17.

Figure 18:
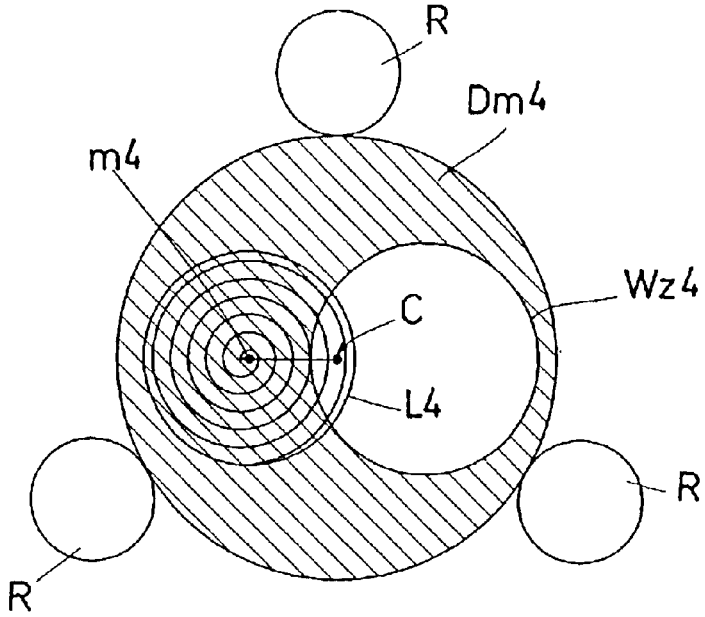
FIG. 18 is an explanatory drawing showing a state in the case where the center of the work piece is deviated from the center axis of the spindle and shifted along the locus of a circular shape, while changing the diameter of the shifting motion.

Next, FIG. 18 indicates a case where the center axis of shifting motion of the work piece W is deviated from the center axis of the spindle 7, and that the diameter of shifting motion of the work piece W is changed in proportion to the shifting in direction Z.

Figure 19:
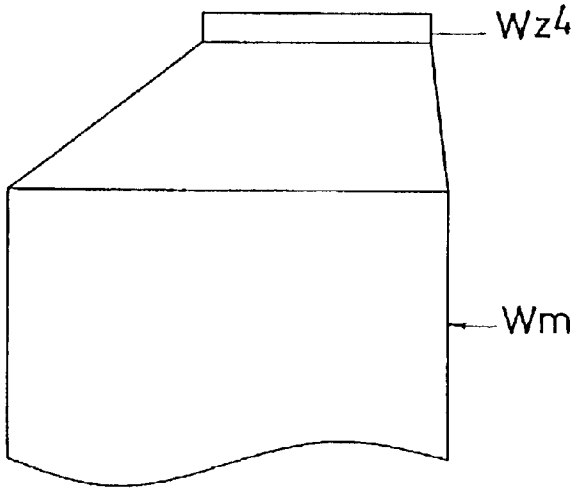
FIG. 19 is a front elevation of the formed piece in the case of FIG. 18.

In this case, that center of shifting motion is at m4 and the shifting locus is L4, and the shaded portion Dm4 is drawn to the minimum diameter Wz4 and, as a result, the work piece W is drawn into an asymmetric circular truncated conical shape as shown in FIG. 19.

Figure 30:
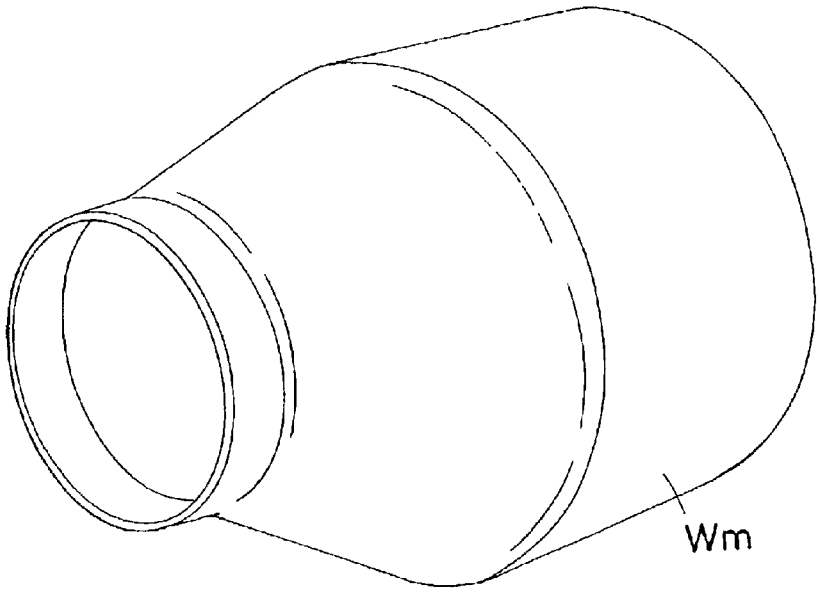
FIG. 30 is a perspective view of the formed piece in the case of FIG. 18.

FIG. 30 shows a perspective view of the formed piece Wm in this case.

Figure 20:
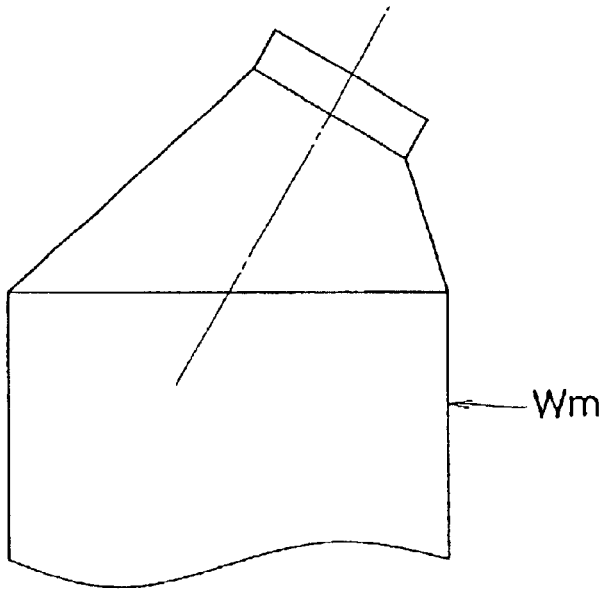
FIG. 20 is an explanatory drawing showing a state in the case where the center of the work piece is deviated at prescribed inclination against the center axis of the spindle and shifted along the locus of a circular shape,while changing the diameter of the shifting motion.

Next, FIG. 20 indicates a case where the center axis of shifting motion of the work piece W is deviated at prescribed inclination against the center axis of the spindle 7.

Figure 12:
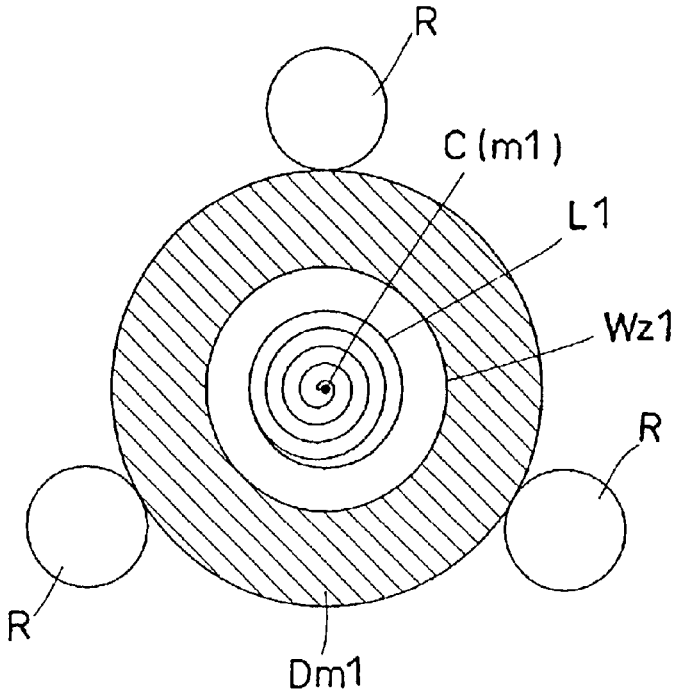
FIG. 12 is an explanatory drawing showing a state in the case where the work piece is shifted along the locus of a circular shape while changing the diameter of the shifting motion.

The shifting locus of the work piece W is the same as that in the embodiment indicated in FIG. 12.

Figure 21:
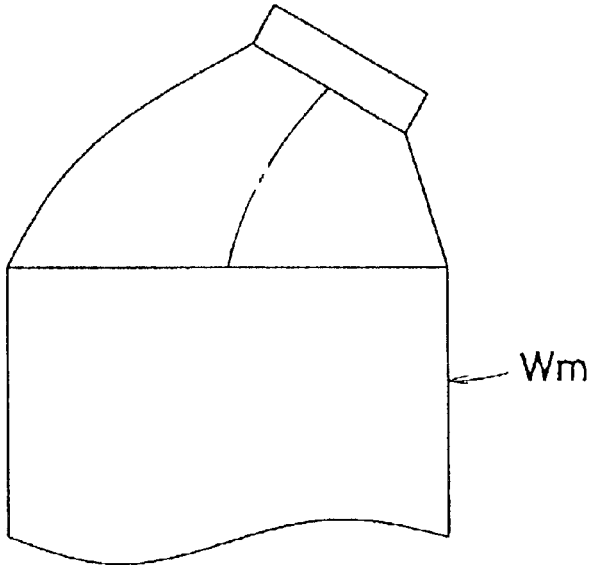
FIG. 21 is an explanatory drawing showing a state in the case where the work piece is shifted along the locus of a circular shape, while changing the inclination at the center and also changing the diameter of the shifting motion.

Next, FIG. 21 further indicates an embodiment in which the inclination is changed during a forming.

The change of inclination may be made, in addition to a certain curved change, in such a way that the displacement of tilt angle changes by P*Q2 (Q2=constant of proportionality) when the shifting in direction Z takes place by a distance P, for example.

Figure 22:
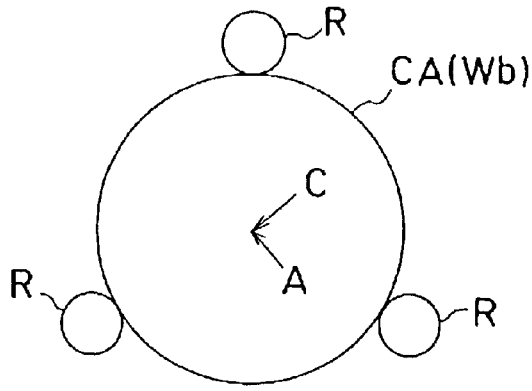
FIG. 22 is an explanatory drawing showing the reference position of the work piece in the case where the work piece is processed into elliptic shape.

Next, FIG. 22 indicates a state of reference position in which the center A of the work piece W is made to agree with the center of rotation C of the drawing roller R, in the case where the work piece W is processed into elliptic shape.

In this case, the locus CA by the drawing roller R agrees with the outer circumference Wb of the drawn work piece W.

Figure 23:
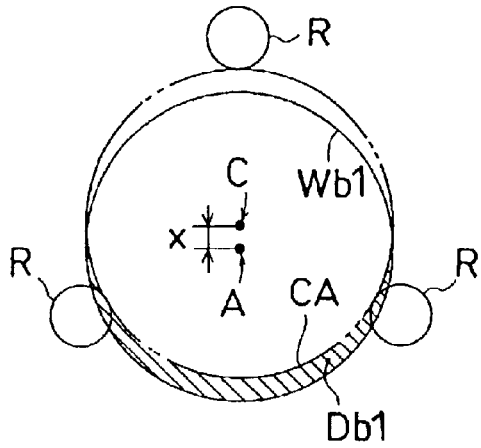
FIG. 23 is an explanatory drawing showing a state in the case where the work piece is shifted downward from the reference position.

Next, FIG. 23 indicates a state in the case where the center A of the work piece W is shifted downward by a distance x from the center of rotation C of the drawing roller R.

In this case, of the locus Wb1 of the work piece W, the portion Db1 off the locus CA by the roller is drawn, and the work piece W takes a circular shape deformed flat in up-down direction.

Figure 24:
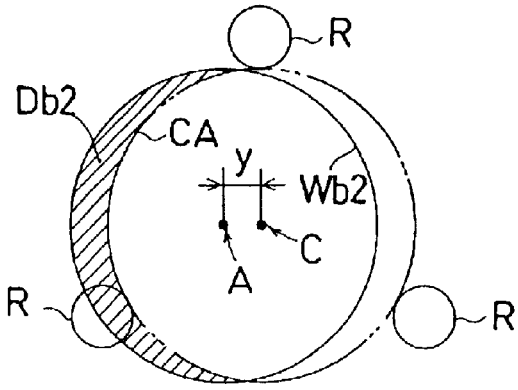
FIG. 24 is an explanatory drawing showing a state in the case where the work piece is shifted to the left from the reference position.

Next, FIG. 24 indicates a state in the case where the center A of the work piece W is shifted to the left by a distance y from the center of rotation C of the drawing roller R.

Also in this case, of the locus Wb2 of the work piece W, the portion Db2 off the locus CA by the roller is drawn, and the work piece W takes a circular shape deformed flat in left-right direction, in the same way as in FIG. 23.

Figure 25:
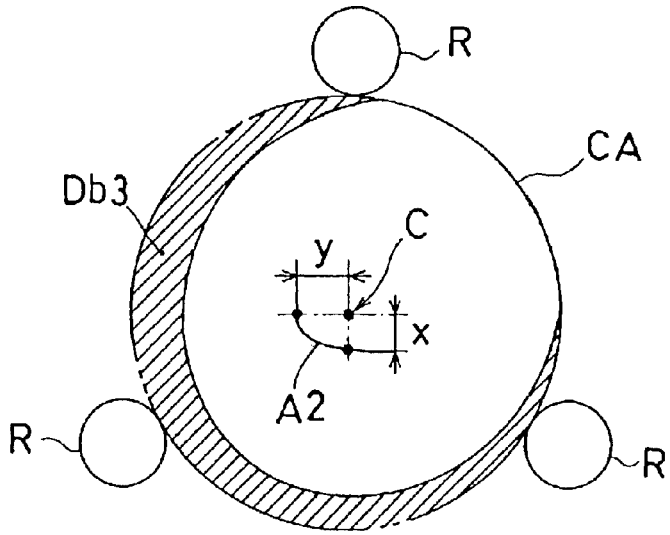
FIG. 25 is an explanatory drawing showing a state in the case where the work piece is shifted downward and to the left from the reference position.

Next, FIG. 25, combination of the states of FIG. 23 and FIG. 24, indicates a case where the center A of the work piece W is shifted downward by a distance x and to the left by a distance y, namely shifted along the ¼ elliptic curve A2, from the center of rotation C of the drawing roller R.

FIG. 25 indicates a state in which the center A of the work piece W is returned to the center of rotation C.

As a result of those motions, the drawn portion Db3 becomes equal to the total of the portions Db1 and Db2 indicated in FIG. 23 and FIG. 24 respectively, and the work piece W takes a circular shape deformed flat in up-down and left-right directions.

Figure 26:
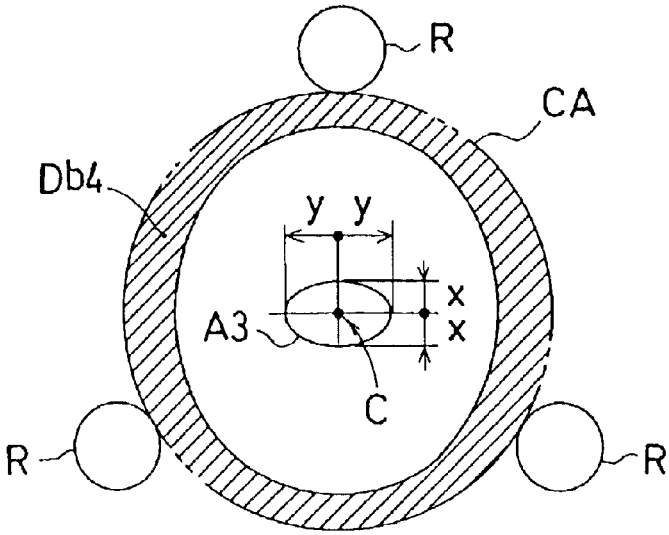
FIG. 26 is an explanatory drawing showing a state in the case where the work piece is shifted along the locus of an elliptic shape.

Next, FIG. 26 indicates a state in the case where the center A of the work piece W is shifted up and down by a distance x and to left and right by a distance y, namely shifted along the elliptic curve A3, from the center of rotation C of the drawing roller R.

FIG. 26 indicates a state in which the center A of the work piece W is returned to the center of rotation C.

As a result, the portion Db4 is drawn, and the work piece W takes a circular shape deformed flat in up-down and left-right directions.

Figure 31:
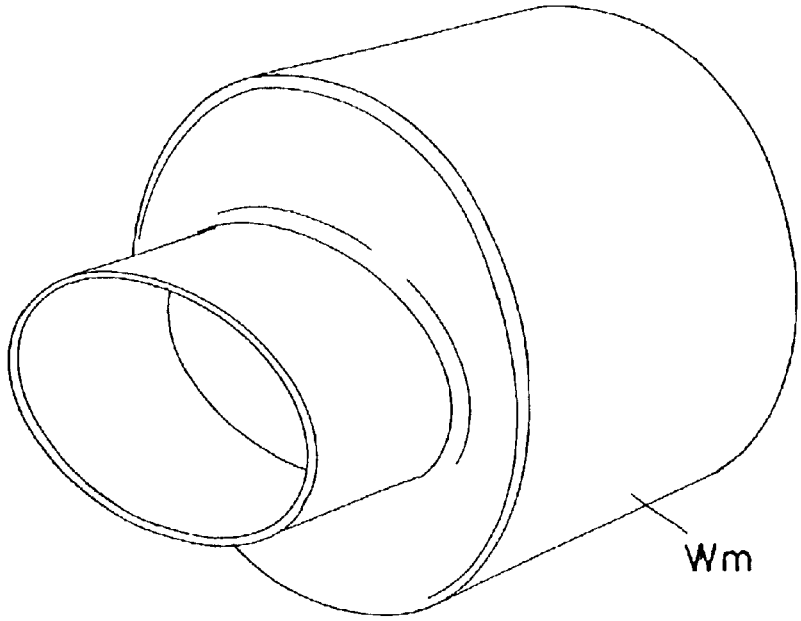
FIG. 31 is a perspective view of the formed piece in the case of FIG. 26.

FIG. 31 shows a perspective view of the formed piece Wm in this case.

Next, in the embodiment indicated in FIG. 21 to FIG. 25, the diameter of shifting motion of the work piece W may further be changed in proportion to the shifting in direction Z.

In this case, a displacement same as that in the case of circular motion of the embodiment indicated in FIG. 12 takes place, and the work piece W is drawn into circular truncated conical shape.

Figure 32:
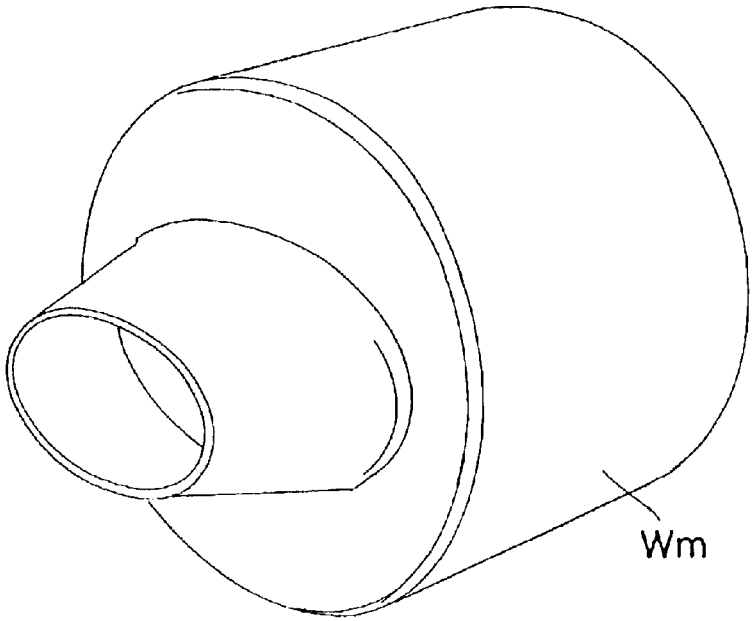
FIG. 32 is a perspective view of the formed piece in the case where the work piece corresponding to FIG. 28 is formed into elliptic shape.

FIG. 32 shows a perspective view of the formed piece Wm in this case.

Those shifting motions of the work piece W are made by inputting, in the control mechanism 10, the amount of shifting motion (shifting locus)of the work piece W (holding mechanism 3 for holding the work piece W), with regard to the center of rotation C of the drawing roller R taken as reference position, amount of displacement between the center of shifting motion and the center axis of the spindle 7, inclination, amount of change in inclination, amount of relative shifting of the spindle mechanism 2 and the holding mechanism 3, etc., to execute drawing work.

In this case, the drawing work can be executed smoothly by controlling the amount of relative shifting of the spindle mechanism 2 and the holding mechanism 3 and the amount of shifting motion of the holding mechanism 3, namely the amount of drawing, in relation to the rotation of the spindle 7.

As processing tool R, a cutting tool may be used selectively, in addition to said drawing tool R.

This makes it possible to execute drawing and cutting selectively on the work piece W, simplifying the manufacturing processes and improving the production efficiency.

Explanation has for far been given on the forming method for a cylindrical work piece and an apparatus for it according to the present invention, based on embodiments. However, the present invention in not limited to the constructions described in the embodiments, but may be changed in construction as required within the scope not deviated from its main purpose, by shifting the axial shifting means 4 for shifting the spindle mechanism 2 and the holding mechanism 3 relatively in the axial direction of the spindle 7, in a way to make the holding mechanism 3 shift in the longitudinal direction instead of the spindle mechanism 2, install the spindle 7 of the spindle mechanism 2 with its axis in horizontal direction instead of vertical direction, etc.

According to the forming method and forming apparatus for cylindrical work piece of the present invention, realized in such a way that, while shifting the spindle mechanism and the holding mechanism relatively in the axial direction of the spindle, the holding mechanism is made to perform prescribed shifting motion so that the processing tool shifts relatively along the outer circumference of the work piece to execute prescribed processing on the work piece, it becomes possible to secure a high degree of freedom for the relative shifting of the processing tool against the work piece and execute forming work on a cylindrical work piece into circular or deformed circular shape, such as ellipse, etc. for example, easily and with high accuracy.

Moreover, in addition to above, it can also simplify the structure on the spindle side, which is liable to be a complicated structure, reduce the manufacturing cost of the apparatus, and facilitate maintenance thereof.

What is claimed is:

1. A forming method for performing forming work on a cylindrical workpiece, comprising:

holding the cylindrical workpiece with a holding mechanism so that the cylindrical workpiece faces a spindle mechanism having a processing tool mounted at a tip of a spindle;

relatively shifting the spindle mechanism and the holding mechanism in the axial direction of the spindle;

moving the holding mechanism in a prescribed two-dimensional shifting motion during said relatively shifting, said moving including moving the holding mechanism with a lifting motor in a vertical direction and shifting the holding mechanism in a lateral direction transverse to the axial direction with a lateral shifting motor; and relatively shifting the processing tool along an outer circumference of the cylindrical workpiece.

2. The forming method of claim 1, wherein the vertical direction is transverse to the axial direction and the lateral direction.

3. The forming method of claim 1, wherein said relatively shifting comprises turning said spindle mechanism only.

4. The forming method of claim 1, wherein the prescribed shifting motion is circular.

5. The forming method of claim 1, wherein the prescribed shifting motion is elliptical.

6. The forming method of claim 1, wherein a shifting motion center holding mechanism deviates from a center axis of the spindle.

7. The forming method of claim 1, wherein a shifting motion center of the holding mechanism deviates at a prescribed inclination with respect to a center axis of the spindle.

8. The forming method of claim 7, wherein said moving the holding mechanism into a prescribed two-dimensional shifting motion further includes changing the prescribed inclination during forming.

9. A forming apparatus for a cylindrical workpiece comprising:

a spindle mechanism having a processing tool mounted at a tip of a spindle;

a holding mechanism for holding the cylindrical workpiece so as to face the spindle mechanism;

an axial shifting mechanism for relatively shifting the spindle mechanism and the holding mechanism in the axial direction of the spindle;

a shifting motion mechanism for shifting the holding mechanism in a prescribed shifting motion during operation of said axial shifting mechanism, said shifting motion mechanism comprising a lifting motor for moving the holding mechanism in a vertical direction and a lateral shifting motor for shifting the holding mechanism in a direction transverse to the axial direction; and a control mechanism for driving for driving said axial shifting mechanism and said shifting motion mechanism in linkage with each other.

10. The forming apparatus of claim 9, wherein said control mechanism drives said lifting motor and said lateral shifting motor in linkage with each other.

11. The forming apparatus of claim 9, and further comprising a holding mechanism deviating mechanism for deviating an axis of the holding mechanism at a prescribed inclination from a center axis of said spindle.

12. The forming apparatus of claim 9, wherein the vertical direction is transverse to the axial direction and the lateral direction.

* * * * *